United States Patent [19]

Block

[11] Patent Number: 4,590,694

[45] Date of Patent: May 27, 1986

[54] SNOW PLOW WITH BAR REINFORCED DEFORMABLE BLADE

[75] Inventor: Harvey P. Block, Westport, Conn.

[73] Assignee: U.S. Highway Products, Inc., Orangeburg, N.Y.

[21] Appl. No.: 698,804

[22] Filed: Feb. 6, 1985

Related U.S. Application Data

[63] Continuation-in-part of Ser. No. 669,581, Nov. 8, 1984.

[51] Int. Cl.[4] ..... E01H 5/04

[52] U.S. Cl. ..... 37/233; 37/141 R; 172/719; 172/772.5

[58] Field of Search ..... 37/233, 266, 141 R, 37/141 T; 172/719, 682, 753, 772, 772.5, 701.1–704, 801; 15/236 R, 245

[56] References Cited

U.S. PATENT DOCUMENTS

| | | | |
|---|---|---|---|
| 2,061,585 | 11/1936 | Meyer | 172/701.3 X |
| 2,265,551 | 12/1941 | Steccone | 15/245 |
| 2,350,437 | 6/1944 | Wiedman | 15/245 X |
| 2,711,552 | 6/1955 | Lengyel | 15/245 X |
| 3,028,692 | 4/1962 | Brock | 15/245 |
| 3,465,456 | 9/1969 | Meyer | 172/701.3 X |
| 3,477,149 | 11/1969 | Wagner | 172/701.3 X |
| 3,851,711 | 12/1974 | Stepe | 172/701.3 |
| 3,888,027 | 6/1975 | Toews | 172/701.3 X |

*Primary Examiner*—E. H. Eickholt

*Attorney, Agent, or Firm*—Jeffrey S. Mednick; Perry Palan

[57] ABSTRACT

A snow plow is provided comprising a steel member having a mold board at its lower end. A snow plow blade extends below the mold board. The snow plow blade comprises a sheet of lightweight material, preferably urethane. This sheet is resistant to corrosion from moisture and salt and to road abrasion. The sheet has a front surface and a back surface, each of which extends from the top of the sheet to the bottom of the sheet to define the thickness of the blade. The thickness is relatively constant. The bottom of the blade is defined by a relatively straight edge for better snow removal. A steel reinforcing bar is mounted in a groove in either the front or the back surface of the sheet. Bolt means mount the steel bar to the sheet and also to the plow.

21 Claims, 15 Drawing Figures

Fig. 14.
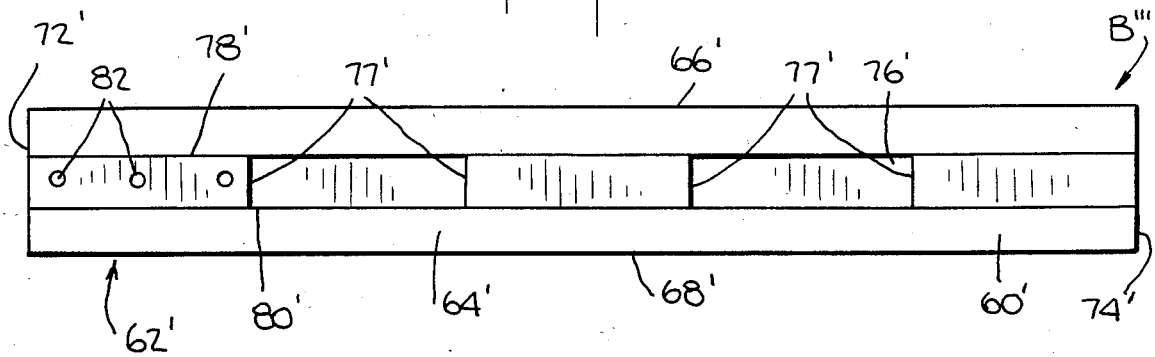
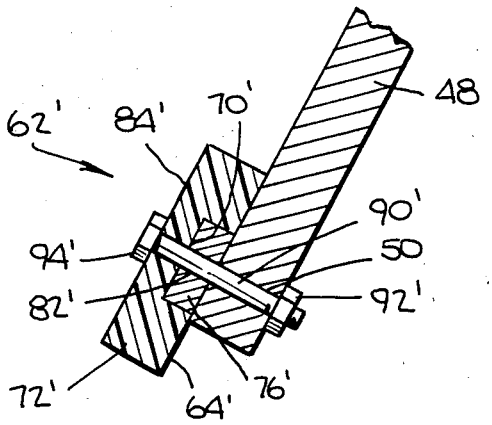
Fig. 15.

SNOW PLOW WITH BAR REINFORCED DEFORMABLE BLADE

CROSS REFERENCE TO RELATED APPLICATION

This application is a continuation-in-part of U.S. Application Ser. No. 669,581, filed on Nov. 8, 1984 and entitled Snow Plow.

BACKGROUND AND SUMMARY OF INVENTION

The present invention relates to an apparatus for plowing snow, and more particularly, to a snow plow, and even more particularly, to a snow plow blade.

Typically, snow plows have been constructed of steel and have a snow plow blade mounted at the lower end, referred to in the trade as mold board. Snow plow blades have been made of either steel or rubber and have been mounted by bolts to the mold board.

Steel blades are obviously very strong, but provide a safety problem when the blade hits a road obstruction or a raised manhole cover or road marker or the like. In addition, since steel blades are so rigid, they must be frequently replaced or re-worked, resulting in high maintenance costs.

Rubber snow plow blades have been used and solve many of the problems of steel blades. Since rubber is more flexible than steel, road obstructions and raised manhole covers do not damage the blade. However, use of a rubber snow plow blade in cold temperatures often causes the rubber to change shape. This results in uneven cleaning of the roads. Also, rubber blades have a tendency to roll under the mold board causing a chattering effect and leaving snow deposits on the road.

It is, therefore, an object of the present invention to provide an improved snow plow and blade.

It is a further object of the present invention to provide a snow plow with a blade that is resistant to corrosion from moisture and salt.

It is a further object of the present invention to provide a snow plow that is resistant to road abrasion.

It is a further object of the present invention to provide a snow plow that will reduce the chance of accidents due to the striking of raised markers, manhole covers and obstructions on the road surface.

It is a further object of the present invention to provide a snow plow with a blade having a useful life much longer than conventional snow plows.

It is a further object of the present invention to provide a snow plow with a blade that will rebound to its original shape even in severe temperatures as cold as −58 degrees Fahrenheit.

It is further object of the present invention to provide a snow plow having a blade with a reduced coefficient of friction.

It is a further object of the present invention to provide a snow plow that minimizes engine wear and maximizes gas mileage.

It is a further object of the present invention to provide a snow plow that is easier to ship and has the above advantages.

These and other objects, advantages and novel features of the present invention will become apparent from the following detailed description of the invention when considered in conjunction with the accompanying drawings which show, for purposes of illustration and example only, a preferred embodiment in accordance with the present invention.

BRIEF DESCRIPTION OF DRAWINGS

FIG. 14 is a front view of a modified snow plow blade made in accordance with the present invention.

FIG. 15 is a cross-sectional view of the snow plow blade of FIG. 14 mounted to a mold board in accordance with the present invention.

DETAILED DESCRIPTION OF INVENTION

Figure 1:
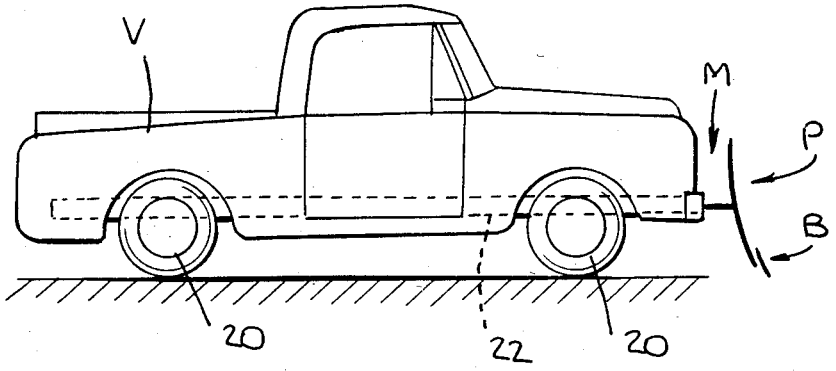
FIG. 1 is a diagrammatic view of an apparatus for plowing snow in accordance with the present invention.

Referring to FIG. 1, there is illustrated diagrammatically a vehicle V having four wheels, two of which are shown at 20 and a frame 22. Mounted to the frame 22 by mounting means M is a snow plow P including a snow plow blade B. While the snow plow blade described hereinbelow is unique, especially in combination with a snow plow and a vehicle, the particular vehicle, snow plow, or mounting means may be selected from numerous commercially available models. Therefore, these items will only be described in general terms. An example of a suitable vehicle is a Ford Bronco. One skilled in the art will recognize that any suitable commercially available vehicle, snow plow or mounting means may be used.

Figure 2:
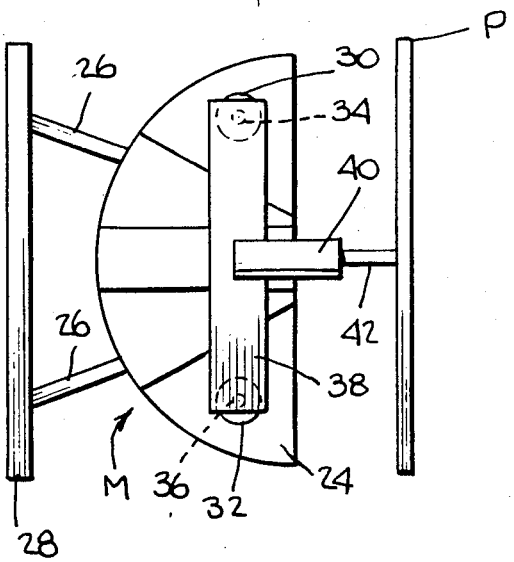
FIG. 2 is a top view of a snow plow mounting means in accordance with the present invention.
Figure 3:
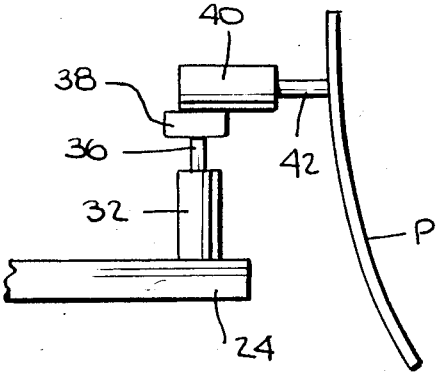
FIG. 3 is a side view of FIG. 2.

For purposes of illustration, a typical, commercially available mounting means M is shown in FIGS. 2 and 3. Mounting means M includes a steel plate 24 with steel struts 26 and steel bracket 28. Bracket 28 may be mounted to frame 22 by any suitable means such as bolts (not shown). Mounted on plate 24 are a pair of cylinders 30 and 32 including pistons 34 and 36 respectively. A steel brace 38 connects pistons 34 and 36. A cylinder 40 is mounted to a top portion of brace 38. Piston 42 extends from cylinder 40 and is also attached to snow plow P. In operation, the operator may raise or lower snow plow P by actuating cylinders 30 and 32 and may move snow plow P forward by actuating cylinder 40. As mentioned above, one skilled in the art will recognize that there are numerous commercially available means for mounting a snow plow to a vehicle and the one illustrated in FIGS. 2 and 3 is only exemplary.

Figure 4:
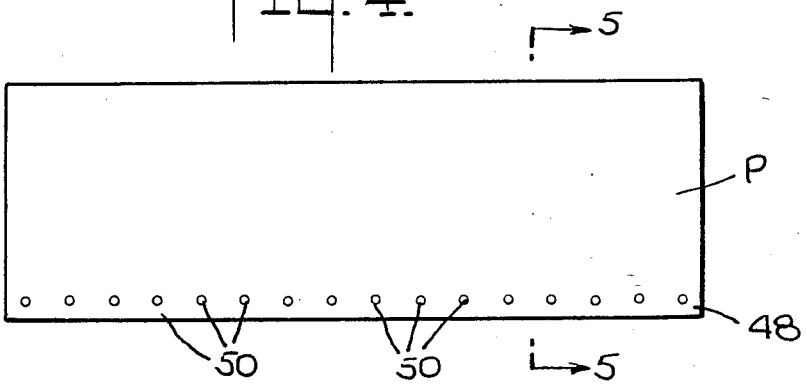
FIG. 4 is a front view of a reversable snow plow.
Figure 5:
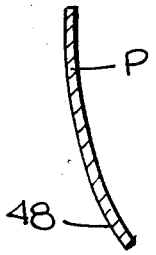
FIG. 5 is a cross-sectional view of the snow plow of FIG. 6 taken along lines 5—5.
Figure 6:
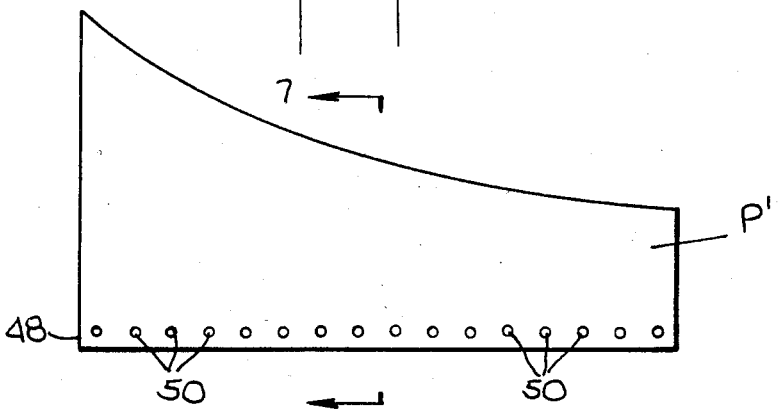
FIG. 6 is a front view of a one-way snow plow.
Figure 7:
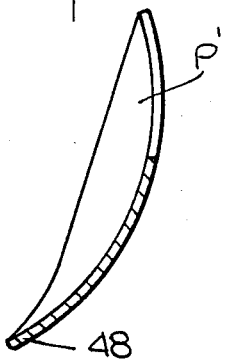
FIG. 7 is a cross-sectional view of the snow plow of FIG. 6 taken along lines 7—7.

Referring to FIGS. 4 and 5, there is shown one type of snow plow that may be used in accordance with the present invention. The snow plow P illustrated is referred to in the art as a reversable plow in that snow may be moved to either the right or the left of the vehicle. The snow plow P' shown in FIGS. 6 and 7 is of the type referred to as a one-way plow. This type of snow plow may only be used to move snow in a single direction (to the right as viewed in the drawing). The bottom portion of either type of snow plow blade is referred to in the art as a mold board as at 48. As shown, mold board 48 includes a plurality of holes 50 for a purpose that will be discussed herein below.

Figure 8:
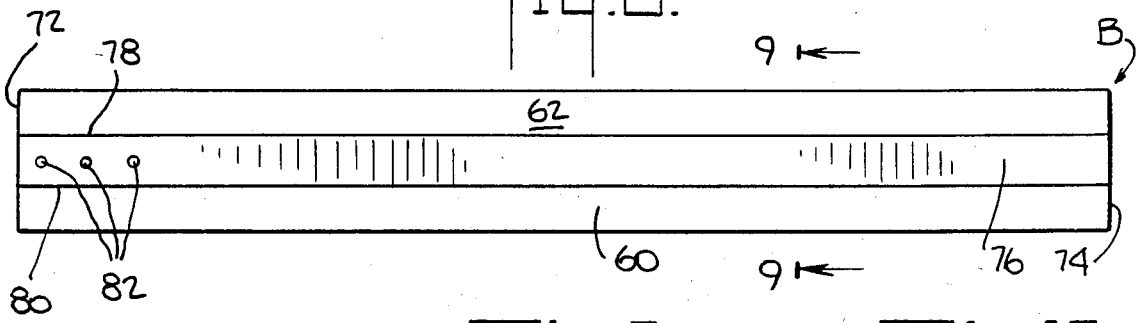
FIG. 8 is a front view of a snow plow blade made in accordance with the present invention.
Figure 9:
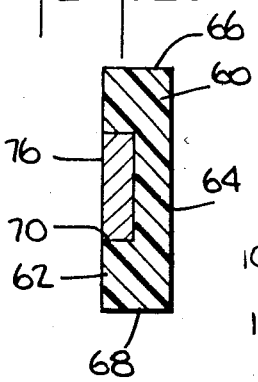
FIG. 9 is a cross-sectional view of the snow plow blade of FIG. 8 taken along lines 9—9.
Figure 10:
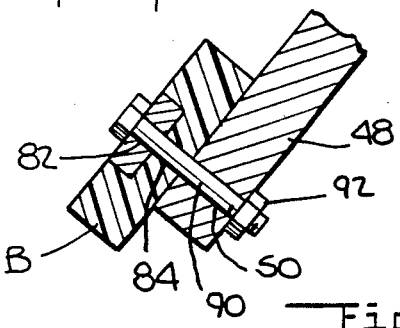
FIG. 10 is a cross-sectional view of a snow plow blade mounted to a mold board in accordance with the present invention.

Referring to FIGS. 8 and 9, there is illustrated a snow plow blade B made in accordance with the present invention. The snow plow blade B comprises a sheet 60 of lightweight material, preferably polyurethane. Sheet 60 has a front surface 62 and a back surface 64 extending from the top 66 of the sheet to the bottom 68 to define a relatively constant thickness of the sheet. The bottom 68 of the sheet is a relatively straight edge for better snow removal. In front surface 62 there is a groove 70 that extends from a first end 72 to a second end 74 of said sheet 60. Groove 70 defines a portion of decreased thickness of said sheet. A reinforcing bar 76, constructed of a relatively strong and rigid material such as steel, has a top surface 78 and a bottom surface 80. Reinforcing bar 76 is seated in groove 70 and substantially fills said groove. Said reinforcing bar 76 includes a plurality of holes 82 (only three of which are shown) aligned with complimentary holes 84 in the portion of decreased thickness of sheet 60. Holes 82 and 84 extend from first end 72 to second end 74. As best seen in FIG. 10, bolts 90 extend through holes 82 and 84 and also through holes 50 in mold board 48 and, along with nuts 92 form a means for mounting bar 76 in groove 70 and a means for mounting the snow plow blade B to mold board 48.

Figure 13:
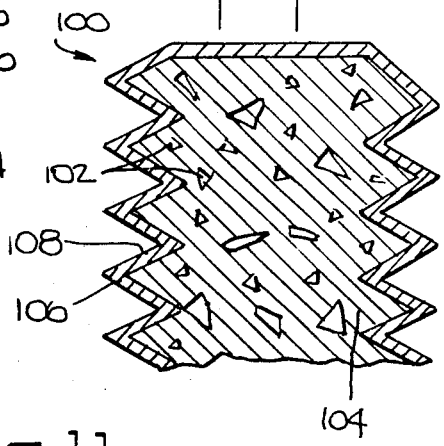
FIGS. 11, 12 and 13 show alternate embodiments of snow plow blades in accordance with the present invention.
Figure 12:
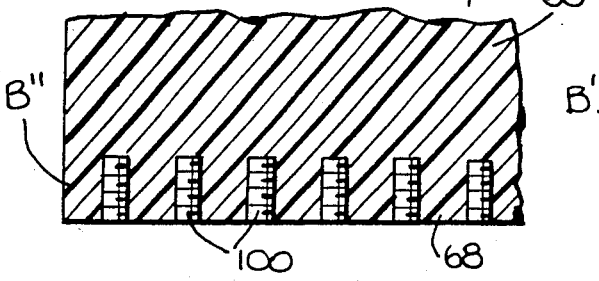
Figure 11:
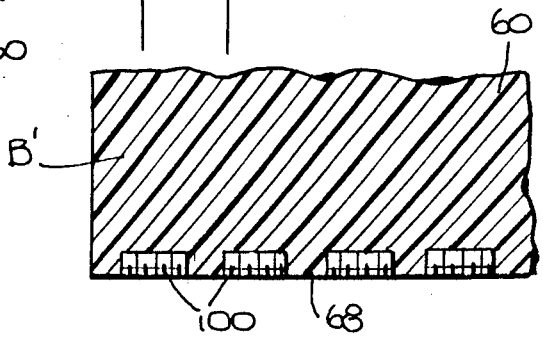

Referring to FIGS. 11, 12 and 13, there are shown alternative embodiments of the present invention. Referring to FIG. 11, there is shown a portion of snow plow blade B' including wear peg 100 embedded therein to reinforce sheet 60. As shown wear pegs 100 are cylindrically shaped and threaded to securely retain them in sheet 60. The wear pegs 100 have a major dimension along their longitudinal axis that is greater than a minor dimension which is the diameter. In the embodiment shown in FIG. 11, the major dimension of wear pegs 100 is parallel to the straight edge along the bottom 68 of sheet 60. In the embodiment illustrated in FIG. 12 snow plow blade B" shows the same wear pegs except that the minor dimension extends in a direction that is parallel to the straight edge of the bottom 68 of sheet 60.

FIG. 13 shows a cross-sectional view of a preferred wear peg 100 in accordance with the present invention. The wear peg shown includes tungsten carbide particles 102 embedded in a bronze alloy matrix 104 and encased in a steel cladding 106. Cylindrical surface of steel cladding 106 includes threads 108. This type of wear shoe is commercially available from the Shwayder Company of Birmingham, Mich. Other wear pegs may be used such as plain steel or carbide. In addition, the wear pegs may have projections or appertures to help anchor the wear pegs in the sheet 60. Also, while cylindrical wear pegs have been shown, it is anticipated that other shapes may be used.

The use of wear pegs in the sheet 60 increases resistance to abrasion and any suitable wear peg arrangement may be utilized.

It has now been discovered that it is often inconvenient to ship a reinforcing bar in one piece. However, when a segmented reinforcing bar is inserted in a groove in the front surface of a snow plow blade as taught herein, there is a tendency for the segments to pop out of the groove allowing the bottom surface of the blade to roll under in operation. The arrangement shown in FIGS. 14 and 15 solves these problems.

Referring to FIG. 14, there is shown a modified snow plow blade B''' in accordance with the present invention. Snow plow blade B''' comprises a sheet 60', also of lightweight material such as polyurethane. Sheet 60' has a front surface 62' and a back surface 64' extending from the top 66' of the sheet to the bottom 68' to define a relatively constant thickness of the sheet. The bottom 68' is a relatively straight edge for better snow removal. In back surface 64' there is a groove 70' that extends from a first end 72' to a second end 74' of sheet 60'. Groove 70' defines a portion of decreased thickness of the sheet. Reinforcing bar 76', constructed of a relatively strong and rigid material such as steel, has a top surface 78' and a bottom surface 80'. As shown in FIG. 14, reinforcing bar 76' is segmented at 77'. Reinforcing bar 76' is seated in groove 70' and substantially fills said groove. A plurality of holes 82' (only three of which are shown) are aligned with complementary holes 84'. Holes 82' and 84' extend from first end 72' to second end 74'.

As shown in FIG. 15, snow plow blade B''' is mounted to the mold board in such a way to present segmented reinforcing bar 76' from popping out of groove 70'. Bolts 90' extend through holes 82' and 84' and also through holes 50 in mold board 48 and, along with nuts 92' from a means for mounting reinforcing bar 76' in groove 70' and a means for mounting reinforcing bar 76' in groove 70' and a means for mounting snow plow blade B''' to mold board 48. If desired, a plate 94' of steel or other suitable material may be used to prevent the heads of bolts 90' from pulling through front surfaces 62'.

One skilled in the art will recognize that wear pegs discussed hereinabove can be incorporated into the modification of FIGS. 14 and 15.

One skilled in the art will recognize that any suitable urethane material may be used for sheet 60 or 60'. However, an example of the preferred embodiment is a sheet having the following physical properties:

| | |
|---|---|
| Shore A Hardness | 85 |
| Shore D Hardness | 32 |
| 100% Modulus | 730 psi |
| 300% Modulus | 1620 psi |
| Tensile | 6240 psi |
| Elongation | 570% |
| D-470 Tear | 140 |
| Bashore Rebound | 35% |
| Compression Set, Method B | 40% |
| Bell Brittle Point | −58° F. |
| Specific Gravity | 1.23 |
| Coefficient of Friction | 0.70 |
| Linear coefficient of thermal expansion in/in/F., 75–212° F. | $1 \times 10^{-4}$ |
| Thermal conductivity, BUT/hr (sq. ft) (F./in) | 0.95 |
| Taber abrasion weight loss, 1000 g load h-18, wheel, 5000 cycles | 10 mg/1000 cycles |
| NBS Abrasion Index | 240 |
| Flash Point | None |
| Melting Point | Over 400° F. |
| MESA Test | Pass |

It may also be desired to use a suitable filler in the urethane material such as aluminum oxide, carbon or graphite, either alone or with wear pegs. For example, the filler could comprise 80 grit aluminum oxide powder or fibers randomly orientated in the urethane. The filler should comprise no more than approximately 15 percent by weight of the urethane or the elastomeric properties of the urethane may be reduced and it may not flow properly in the molding process. To make the blade, the urethane is heated to a temperature of approximately 185 degrees Fahrenheit so that it is in liquid form and the powder is added and mixed. The compound is then poured into a mold to cure. It is then heated again to approximately 170 degrees Fahrenheit as a post curing operation. A suitable aluminum oxide powder is commercially available from 3R Mineral and Manufacturing Company of Morton Grove, Ill. The use of a suitable filler as described herein will increase the tensile strength and tear strength and help dissipate heat developed in the snow plow blade. This further increases the useful life of the blade.

One skilled in the art will also recognize that reinforcing bar 76 may be made of any suitable material, however, a high carbon steel is preferred.

Also, by way of example, snow plows and blades in accordance with the present invention may be made of any length, such as ten feet. In a preferred embodiment, the sheet 60' is 1¼ inches thick and reinforcing bar 76' is ½ inch thick. Half-inch bolts are spaced approximately 6 inches along the blade. Each segment is approximately two feet long. Also, while the holes in the reinforcing bar and in the sheet have been shown as being at the center of the groove 70', it should be appreciated that these holes may be punched below center to provide more support for the sheet at its bottom surface.

In operation, when the snow plow is dropped, a downward load is applied to sheet 60' and reinforcing bar 76' by the bolts 90'. The downward force provides adequate pressure for slicing and removing packed snow. The sheet 60' having a relatively low coefficient of friction slides along the surface to be plowed.

Although the present invention has been described and illustrated above in detail, it is to be clearly understood that the same is by way of illustration and example only and is not to be taken by way of limitation. The spirit and scope of this invention are to be limited only by the terms of the appended claims.

What is claimed:

1. A snow plow blade for mounting to a mold board of a snow plow comprising:

a sheet of flexible lightweight material capable of returning substantially to its original shape after deformation, said sheet being resistant to corrosion from moisture and salt and to road abrasion;

said sheet having a front surface and a back surface to be adjacent said mold board, each of said surfaces extending from the top of said sheet to define the thickness of the blade, said thickness being relatively constant;

said bottom being defined by a relatively straight edge for better snow removal;

a groove in said back surface displaced from a bottom edge of said sheet and extending from a first end of said sheet to a second end of said sheet, said groove defining a portion of decreased thickness in said sheet;

a reinforcing bar in said groove, said bar having a top surface and a bottom surface and being constructed of a relatively strong and rigid material to reinforce said sheet in the direction of the plane of the back surface; and means for mounting said bar in said groove.

2. A snow plow blade as defined in claim 1, wherein said reinforcing bar is segmented.

3. A snow plow blade as defined in claim 2, wherein said lightweight material is polyurethane having a filler means for increasing the strength of the blade and for dissipating heat developed in the blade to increase the useful life of the blade.

4. A snow plow blade as defined in claim 3, wherein said bar is steel.

5. A snow plow blade as defined in claim 4, wherein said means for mounting said bar is said groove comprises:

(a) a plurality of holes in said bar;

(b) complementary holes in said portion of decreased thickness; and (c) bolt means extending through said plurality of holes and said complementary holes.

6. A snow plow blade as defined in claim 5, wherein said plurality of holes in said bar are closer to said bottom surface to provide more rigidity to the bottom of said sheet.

7. A snow plow blade as defined in claim 3, wherein said filler means is aluminum oxide.

8. A snow plow comprising a steel member having a mold board, a snow plow blade extending below said mold board, and means for mounting said snow plow blade to said mold board, said snow plow blade comprising:

a sheet of flexible lightweight material capable of returning substantially to its original shape after deformation, said sheet being resistant to corrosion from moisture and salt and to road abrasion;

said sheet having a front surface and a back surface to be adjacent said mold board, each of said surfaces extending from the top of said sheet to define the thickness of the blade, said thickness being relatively constant;

said bottom being defined by a relatively straight edge for better snow removal;

a groove in said back surface displaced from a bottom edge of said sheet and extending from a first end of said sheet to a second end of said sheet, said groove defining a portion of decreased thickness in said sheet;

a reinforcing bar in said groove, said bar having a top surface and a bottom surface and being constructed of a relatively strong and rigid material to reinforce said sheet in the direction of the plane of the back surface; and means for mounting said bar in said groove.

9. A snow plow as defined in claim 8, wherein said reinforcing bar is segmented.

10. A snow plow as defined in claim 9, wherein said lightweight material is polyurethane having a filler means for increasing the strength of the blade and for dissipating heat developed in the blade to increase the useful life of the blade.

11. A snow plow as defined in claim 10, wherein said bar is steel.

12. A snow plow as defined in claim 11, wherein said means for mounting said bar in said groove and said means for mounting said snow plow blade to said mold board comprise (a) a plurality of holes in said bar;

(b) complementary holes in said portion of decreased thickness;

(c) additional complementary holes in said mold board, and bolt means extending through said plurality of holes, said complementary holes and said additional complementary holes.

13. A snow plow as defined in claim 12, wherein said plurality of holes in said bar are closer to said bottom surface to provide more rigidity to the bottom of said sheet.

14. A snow plow as defined in claim 10, wherein said filler means is aluminum oxide.

15. An apparatus for plowing snow comprising a vehicle having four wheels and a frame, a snow plow mounted to said frame, said snow plow blade extending below said mold board, and means for mounting said snow plow blade to said mold board, said snow plow blade comprising:

a sheet of flexible lightweight material capable of returning substantially to its original shape after deformation, said sheet being resistant to corrosion from moisture and salt and to road abrasion;

said sheet having a front surface and a back surface to be adjacent said mold board, each of said surfaces extending from the top of said sheet to define the thickness of the blade, said thickness being relatively constant;

said bottom being defined by a relatively straight edge for better snow removal;

a groove in said back surface displaced from a bottom edge of said sheet and extending from a first end of said sheet to a second end of said sheet, said groove defining a portion of decreased thickness in said sheet;

a reinforcing bar in said groove, said bar having a top surface and a bottom surface and being constructed of a relatively strong and rigid material to reinforce said sheet in the direction of the plane of the back surface; and means for mounting said bar in said groove.

16. An apparatus as defined in claim 16, wherein said reinforcing bar is segmented.

17. An apparatus as defined in claim 16, wherein said lightweight material is polyurethane having a filler means for increasing the strength of the blade and for dissipating heat developed in the blade to increase the useful life of the blade.

18. An apparatus as defined in claim 17, wherein said bar is steel.

19. An apparatus as defined in claim 18, wherein said means for mounting said bar in said groove and said groove and said means for mounting said snow plow blade to said mold board comprise:

(a) a plurality of holes in said bar;

(b) complementary holes in said portion of decreased thickness; and (c) additional complementary holes in said mold board, and bolt means extending through said plurality of holes, said complementary holes and said additional complementary holes.

20. An apparatus as defined in claim 19, wherein said plurality of holes in said bar are closer to said bottom surface to provide more rigidity to the bottom of said sheet.

21. An apparatus as defined in claim 15, wherein said filler means is aluminum oxide.

* * * * *